US012422196B2

(12) United States Patent
Wang et al.

(10) Patent No.: US 12,422,196 B2
(45) Date of Patent: Sep. 23, 2025

(54) HEAT EXCHANGER AND PROCESSING METHOD THEREFOR

(71) Applicant: SANHUA (HANGZHOU) MICRO CHANNEL HEAT EXCHANGER CO., LTD., Zhejiang (CN)

(72) Inventors: Feng Wang, Zhejiang (CN); Jianlong Jiang, Zhejiang (CN); Qiang Gao, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 202 days.

(21) Appl. No.: 17/928,752

(22) PCT Filed: May 28, 2021

(86) PCT No.: PCT/CN2021/096833
§ 371 (c)(1),
(2) Date: Nov. 30, 2022

(87) PCT Pub. No.: WO2021/244433
PCT Pub. Date: Dec. 9, 2021

(65) Prior Publication Data

US 2023/0332844 A1 Oct. 19, 2023

(30) Foreign Application Priority Data

May 31, 2020 (CN) ..... 202010481352.9
Jun. 9, 2020 (CN) ..... 202021054597.5

(51) Int. Cl.
*F28F 1/00* (2006.01)
*B21D 53/06* (2006.01)
(Continued)

(52) U.S. Cl.
CPC ..... *F28F 1/025* (2013.01); *B21D 53/06* (2013.01)

(58) Field of Classification Search
CPC ..... F28F 1/025; F28F 1/006; F28D 1/0478; F28D 1/0477; F28D 1/0476;
(Continued)

(56) References Cited

U.S. PATENT DOCUMENTS

2003/0183378 A1* 10/2003 Memory ..... F28F 1/128 165/176
2011/0247791 A1* 10/2011 Jiang ..... F28D 1/0475 165/173
(Continued)

FOREIGN PATENT DOCUMENTS

CA 2930824 A1 11/2017
CN 102878852 A 1/2013
(Continued)

OTHER PUBLICATIONS

International Search Report dated Jul. 29, 2021 for corresponding International Application No. PCT/CN2021/096833, filed May 28, 2021.
(Continued)

*Primary Examiner* — Frantz F Jules
*Assistant Examiner* — Jason N Thompson
(74) *Attorney, Agent, or Firm* — David D. Brush; Westman, Champlin & Koehler, P.A.

(57) ABSTRACT

A heat exchanger includes a header and a plurality of heat exchange tubes. The header includes a first tube and a second tube spaced apart from each other. The heat exchange tube includes a first section, a processing section and a second section. The processing section is connected between the first section and the second section. A processing method for a heat exchanger includes: twisting the processing section relative to the first section and the second section in a length direction of the first tube; bending the first section and the second section relative to the processing section; and pushing the processing section by a predetermined distance in the same direction as a direction in which the processing section is twisted.

9 Claims, 8 Drawing Sheets

(51) Int. Cl.
*F28D 1/02* (2006.01)
*F28D 1/047* (2006.01)
*F28F 1/02* (2006.01)

(58) Field of Classification Search
CPC ..... F28D 1/0475; F28D 1/0471; F28D 1/047; F28D 2001/0273; F28D 2001/0266
See application file for complete search history.

(56) References Cited

U.S. PATENT DOCUMENTS

| | | | | |
|---|---|---|---|---|
| 2015/0168071 | A1* | 6/2015 | Gao | F28D 1/0233 29/890.03 |
| 2016/0290736 | A1* | 10/2016 | He | F28F 1/025 |
| 2017/0211892 | A1* | 7/2017 | Lim | F28D 7/0041 |

FOREIGN PATENT DOCUMENTS

| | | | | |
|---|---|---|---|---|
| CN | 105627633 | A | 6/2016 | |
| CN | 109990627 | A | 7/2019 | |
| CN | 213120167 | U | 5/2021 | |
| EP | 654645 | A2 * | 5/1995 | F28D 1/0476 |
| WO | 2019202557 | A1 | 10/2019 | |

OTHER PUBLICATIONS

Written Opinion of the International Searching Authority dated Jul. 29, 2021 for corresponding International Application No. PCT/CN2021/096833, filed May 28, 2021.

English translation of the Written Opinion of the International Searching Authority dated Jul. 29, 2021 for corresponding International Application No. PCT/CN2021/096833, filed May 28, 2021.

* cited by examiner

HEAT EXCHANGER AND PROCESSING METHOD THEREFOR

CROSS-REFERENCE TO RELATED APPLICATIONS

This application is a national phase entry under 35 USC § 371 of International Application No. PCT/CN2021/096833, filed on May 28, 2021, which claims priority to and benefits of Chinese Patent Application No. 202010481352.9, filed on May 31, 2020, and Chinese Patent Application No. 202021054597.5, filed on Jun. 9, 2020, the entire contents of which are incorporated herein by reference.

FIELD

Embodiments of the present disclosure relate to a field of heat exchange technologies, and more particularly to a heat exchanger and a processing method for the same.

BACKGROUND

Micro-channel heat exchangers are widely used in various air conditioning fields. In the related art, the micro-channel heat exchanger includes a plurality of heat exchange tubes, and the plurality of heat exchange tubes include a bent part, and the bent part of the heat exchange tube is twisted relative to other parts of the heat exchange tube. In the twisted and bent micro-channel heat exchanger, dust and moisture in the air tend to accumulate in the torsion section of the heat exchanger for a long time, which tends to corrode the heat exchange tube.

SUMMARY

A processing method for a heat exchanger according to embodiments of a first aspect of the present disclosure includes: preparing a heat exchanger, in which the heat exchanger includes a first tube, a second tube, and a plurality of heat exchange tubes, the plurality of heat exchange tubes are arranged in parallel along a length direction of the first tube, the heat exchange tube is connected with the first tube and the second tube to communicate the first tube with the second tube, a peripheral profile of a cross section of the heat exchange tube is generally flat, the heat exchange tube includes a first side surface and a second side surface arranged parallel to each other in a thickness direction of the heat exchanger tube, the heat exchanger further includes a third side surface and a fourth side surface arranged parallel to each other in a width direction of the heat exchanger, a maximum distance between the first side surface and the second side surface of the heat exchange tube is smaller than a maximum distance between the third side surface and the fourth side surface of the heat exchange tube, projections of the first side surface, the second side surface, the third side surface and the fourth side surface in the cross section of the heat exchange tube form the peripheral profile of the cross section of the heat exchange tube, the heat exchange tube includes a first section, a processing section and a second section, one end of the first section of the heat exchange tube is communicated with one end of the processing section, the other end of the first section is communicated with the first tube, one end of the second section of the heat exchange tube is communicated with the other end of the processing section, and the other end of the second section is communicated with the second tube; twisting the processing section of the heat exchange tube relative to the first section and the second section of the heat exchange tube along the length direction of the first tube, so that an angle between a first side surface of the twisted processing section of at least part of the heat exchange tubes and a first side surface of the first section of the heat exchange tube is greater than 0 degrees and less than or equal to 90 degrees; bending the processing section along its length direction to make the processing section U-shaped or V-shaped, and an included angle between the first section and the second section of the heat exchange tube being reduced to a predetermined angle; pushing the processing section by a predetermined distance along the same direction as a direction in which the processing section of the heat exchange tube is twisted, and the predetermined distance being greater than or equal to 0.1 times of a width of the heat exchange tube.

A heat exchanger according to embodiments of a second aspect of the present disclosure includes: a first tube and a second tube spaced apart from each other; a plurality of heat exchange tubes spaced apart from each other, a peripheral profile of a cross section of the heat exchange tube is generally flat, the heat exchange tube includes a first side surface and a second side surface arranged in parallel in a thickness direction of the heat exchange tube, the heat exchange tube further includes a third side surface and a fourth side surface arranged in parallel in a width direction of the heat exchange tube, a maximum distance between the first side surface and the second side surface of the heat exchange tube is smaller than a maximum distance between the third side surface and the fourth side surface of the heat exchange tube, the peripheral profile of the cross section of the heat exchange tube includes projections of the first side surface, the second side surface, the third side surface and the fourth side surface in the cross section of the heat exchange tube, the first side surface of the heat exchange tube intersects with the third side surface of the heat exchange tube at a first edge, the second side surface of the heat exchange tube intersects with the fourth side surface of the heat exchange tube at a second edge, the second side surface of the heat exchange tube intersects with the third side surface of the heat exchange tube at a third edge, the first side surface of the heat exchange tube intersects with the fourth side surface of the heat exchange tube at a fourth edge, the heat exchange tube includes a first section, a second section and a bent section, one end of the bent section of the heat exchange tube is connected with one end of the first section of the heat exchange tube, the other end of the bent section of the heat exchange tube is connected with one end of the second section of the heat exchange tube, the other end of the first section of the heat exchange tube is connected with the first tube, the other end of the second section of the heat exchange tube is connected with the second tube, and the heat exchange tube communicates the first tube with the second tube. In a first plane parallel to a first edge and a third edge of the first section, one end of a projection line of a second edge of the bent section is connected with a projection line of a second edge of the first section, a distance between the other end of the projection line of the second edge of the bent section and an extension line of a projection line of the first edge of the first section is denoted L, and L of the plurality of heat exchange tubes satisfies a formula: $1.1\times Tw \leq L \leq 3\times Tw$, wherein Tw is a width of the heat exchange tube.

DETAILED DESCRIPTION

Figure 1:
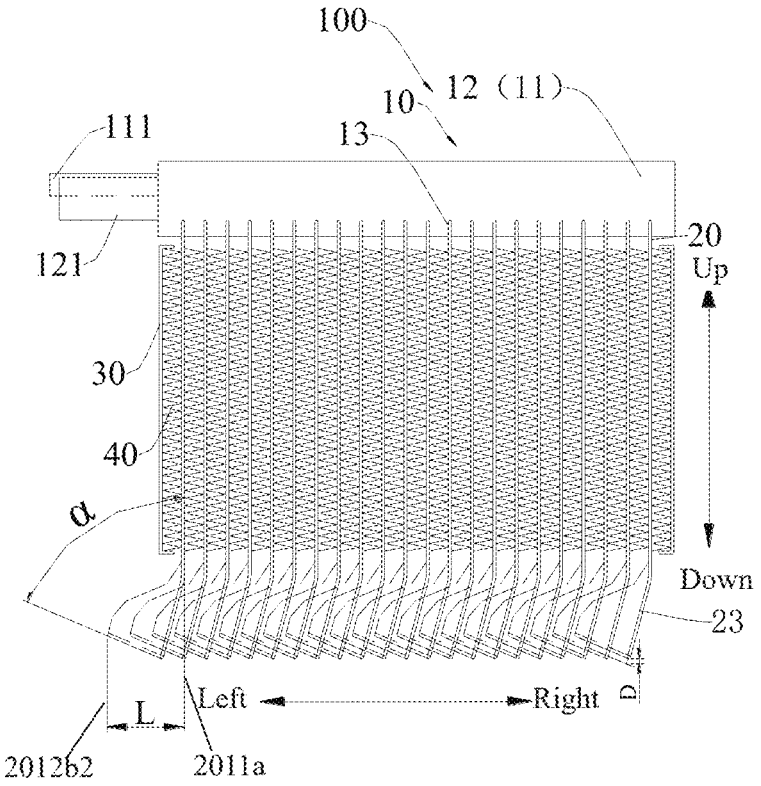
FIG. 1 is a schematic view of a heat exchanger according to an embodiment of the present disclosure.

Reference will be made in detail to embodiments of the present disclosure. Examples of the embodiments are shown in the drawings. The embodiments described below with reference to drawings are illustrative and used to generally explain the present disclosure, and shall not be construed to limit the present disclosure. In the description of the present disclosure, it should be understood that, orientation or position relationships indicated by terms such as "central", "longitudinal", "lateral", "length", "width", "thickness", "up", "down", "front", "rear", "left", "right", "vertical", "horizontal", "top", "bottom", "inner", "outer", "clockwise", "anticlockwise", "axial", "radial", "circumferential" should be construed to refer to the orientation or position relationships as shown in the drawings under discussion. These terms are only for convenience and simplification of description of the present disclosure, and do not indicate or imply that the device or element referred to should have a particular orientation or be constructed or operated in a particular orientation. Therefore, they should not be construed as a limitation to the present disclosure.

Figure 4:
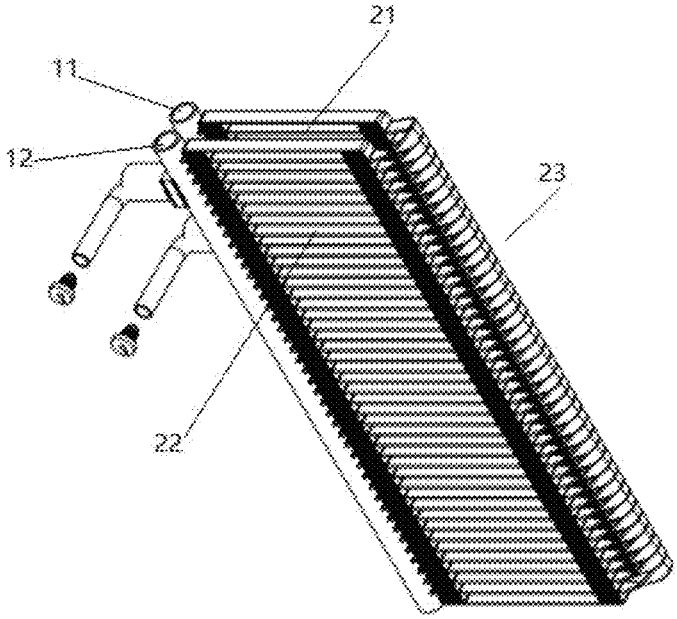
FIG. 4 is a perspective view of the heat exchanger in FIG. 1 or FIG. 2.

A heat exchanger according to an embodiment of the present disclosure is described below with reference to FIG. 1, FIG. 4 and FIG. 5.

As shown in FIG. 1, the heat exchanger 100 according to the present disclosure includes a header 10 and a plurality of heat exchange tubes 20.

The header 10 includes a first tube 11 and a second tube 12, and the first tube 11 and the second tube 12 are apart spaced from each other. As shown in FIG. 1, the first tube 11 and the second tube 12 each extend along a left-right direction and spaced apart from each other in a front-rear direction perpendicular to the page of FIG. 1, and the first tube 11 is located behind the second tube 12.

The plurality of heat exchange tubes 20 are spaced apart from each other, and a peripheral profile of a cross section of the heat exchanger tube 20 is substantially flat, i.e. the heat exchange tube 20 is a flat tube. As shown in FIG. 1, the plurality of heat exchange tubes 20 are spaced apart from each other in the left-right direction, each heat exchange tube 20 has a length, a width and a thickness, the length is larger than the width, and the width is greater than the thickness. The length of the heat exchange tube 20 is defined in an up-down direction, the width of the heat exchange tube 20 is defined in the front-rear direction, and the thickness of the heat exchange tube 20 is defined in the left-right direction.

Figure 5:
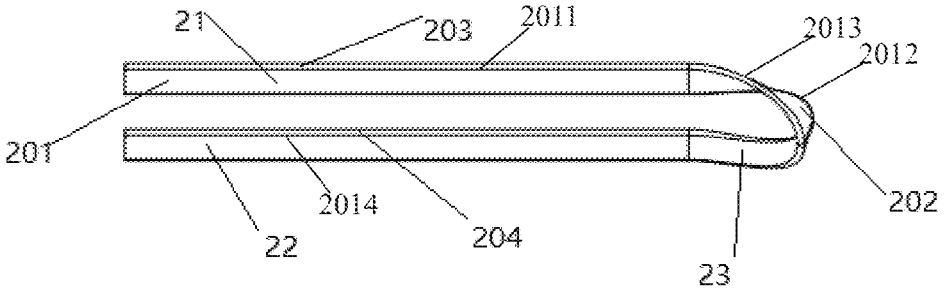
FIG. 5 is a schematic view of a heat exchange tube of the heat exchanger in FIG. 1 or FIG. 2.

As shown in FIG. 5, the heat exchange tube 20 includes a first side surface 201 and a second side surface 202 arranged parallel to each other in a thickness direction of the heat exchange tube 20, the heat exchange tube 20 further includes a third side surface 203 and a fourth side surface 204 arranged parallel to each other in a width direction of the heat exchange tube 20, and the maximum distance between the first side surface 201 and the second side surface 202 of the heat exchange tube 20 is smaller than the maximum distance between the third side surface 203 and the fourth side surface 204 of the heat exchange tube 20. The peripheral profile of the cross section of the heat exchange tube 20 includes the projections of the first side surface 201, the second side surface 202, the third side surface 203 and the fourth side surface 204 of the heat exchange tube 20 in the cross section of the heat exchange tube 20.

The first side surface 201 of the heat exchange tube 20 intersects with the third side surface 203 of the heat exchange tube 20 at a first edge 2011, the second side surface 202 of the heat exchange tube 20 intersects with the fourth side surface 204 of the heat exchange tube 20 at a second edge 2012, and the second side surface 202 of the heat exchange tube 20 intersects with the third side surface 203 of the heat exchange tube 20 at a third edge 2013.

As shown in FIG. 1, the heat exchange tube 20 includes a first section 21, a second section 22 and a bent section 23. One end of the bent section 23 of the heat exchange tube 20 is connected with one end of the first section 21 of the heat exchange tube 20, and the other end of the bent section 23 of the heat exchange tube 20 is connected with one end of the second section 22 of the heat exchange tube 20. The other end of the first section 21 of the heat exchange tube 20 is connected with the first tube 11, the other end of the second section 22 of the heat exchange tube 20 is connected with the second tube 12, and the heat exchange tube 20 communicates the first tube 11 with the second tube 12.

As shown in FIG. 1, the first tube 11 and the second tube 12 are both provided with a heat-exchange-tube interface 13, the other end of the first section 21 of the heat exchange tube 20 is connected to the heat-exchange-tube interface 13 of the first tube 11, and the other end of the second section 22 of the heat exchange tube 20 is connected to the heat-exchange-tube interface 13 of the second tube 12.

As shown in FIG. 1, the second section 22 and the first section 21 are spaced apart from each other in the front-rear direction, and the second section 22 is located in front of the first section 21. One end of the bent section 23 is connected to a lower end of the first section 21, an upper end of the first section 21 is inserted into the first pipe 11, the other end of the bent section 23 is connected to a lower end of the second section 22, and an upper end of the second section 22 is inserted into the second pipe 12.

In a first plane parallel to a first edge and a third edge of the first section 21 (such as a plane parallel to the left-right direction and the up-down direction in FIG. 1), one end of a projection line of a second edge of the bent section 23 is connected with a projection line of a second edge of the first section 21, a distance between the other end **2012*b*1 of the projection line of the second edge of the bent section 23 and an extension line of a projection line 2011*a* of the first edge of the first section 21** is denoted as L, and L of the plurality of heat exchange tubes satisfies a formula: $1.1\times Tw \leq L \leq 3\times Tw$, where Tw is the width of the heat exchange tube.

In the heat exchanger according to the embodiments of the present disclosure, the bent section of the heat exchange tube protrudes toward a side where the torsion occurs (for example, in the thickness direction of the heat exchange tube or the length direction of the first tube), and L satisfies the formula: $1.1\times Tw \leq L \leq 3\times Tw$, so that more dust and condensed water on an outer surface of the bent section can be discharged out of the heat exchanger, thus reducing the accumulation, which is conducive to slowing down the corrosion of the heat exchange tube and reducing the risk of leakage.

After research, the inventor found that a protrusion size of the bent section of the heat exchange tube should not be too small, which otherwise will lead to insufficient inclination, and the accumulated dust and other sundries cannot be discharged, and that the protrusion size should not be too large, which otherwise will lead to a too small gap or a contact between the bent sections of the adjacent heat exchange tubes, so that the condensed water cannot flow into the bottom along this section to take away the accumulated dust, and this section will become an area prone to accumulate dust and other sundries. Moreover, the inventor considered that the wider the width of the heat exchange tube, the larger the protrusion size will be, so as to ensure the inclination angle. Therefore, in the present disclosure, the protrusion size of the bent section of the heat exchange tube is associated with the width Tw of the heat exchange tube, and an appropriate size is determined.

Specifically, as shown in FIG. 1, the heat exchanger 100 further includes a first connecting tube 111 and a second connecting tube 112, a right end of the first connecting tube 111 is connected to a left end of the first pipe 11, and a right end of the second connecting tube 112 is connected to a left end of the second pipe 12, so as to input and output a refrigerant through the connecting tubes. The bent section 23 protrudes toward a left side of the heat exchange tube 20.

In some embodiments, the bent section 23 includes a torsion part and an arc part, one bent section 23 and another bent section 23 adjacent in a thickness direction of its arc part are at least partially opposite in the thickness direction of the arc part. In other words, in the plurality of heat exchange tubes 20, the arc parts of adjacent bent sections 23 are at least partially opposite in the thickness direction of the arc part.

In some embodiments, the bent sections 23 of the heat exchange tubes 20 adjacent to each other in a length direction of the first tube 11 have a gap D therebetween. As shown in FIG. 1, in the plurality of heat exchange tubes 20, the arc parts of the adjacent bent sections 23 have the gap D in the thickness direction of the arc part.

In some embodiments, the first tube 11 and the second tube 12 are arranged parallel to each other, a plurality of first sections 21 are arranged in parallel along the length direction of the first pipe 11, and a plurality of second sections 22 are arranged in parallel along a length direction of the second pipe 12.

As shown in FIG. 1, the upper ends of the first sections 21 of the plurality of heat exchange tubes 20 are inserted into the first tube 11, and the plurality of first sections 21 are arranged in parallel and spaced apart along the length direction of the first tube 11. The upper ends of the second sections 22 of the plurality of heat exchange tubes 20 are inserted into the second tube 12, and the plurality of second sections 22 are arranged in parallel and spaced apart along the length direction of the second tube 12.

The heat exchanger 100 further includes a fin 40 arranged between the first sections 21 adjacent to each other in the length direction of the first tube 11 and between the second sections 22 adjacent to each other in the length direction of the second tube 12.

As shown in FIG. 1, the fin 40 is arranged between any adjacent first sections 21 and between any adjacent second sections 22. Specifically, no fin is arranged between any adjacent bent sections 23.

In some embodiments, the fin 40 is a folded fin extending in a generally wavy shape. The fin can increase the heat exchange area of two adjacent heat exchange tubes and improve the heat exchange efficiency of the heat exchanger.

In some embodiments, one end **2011*b*1 of a projection line 2011*b* of a first edge of the bent section 23 in the first plane is connected to the projection line 2011*a* of the first edge of the first section 21 in the first plane, and a connecting line (or rather, its extension line) between the other end 2011*b*2 of the projection line of the first edge of the bent section 23 in the first plane and the other end 2012*b*1 of the projection line of the second edge of the bent section 23 in the first plane and the projection line (or rather, its extension line) of the first edge of the first section 21 in the first plane define an included angle denoted as a therebetween, and the included angle $\alpha$ is greater than 10 degrees and less than 60 degrees. The connecting line between the other end of the projection line of the first edge of the bent section 23 in the first plane and the other end of the projection line of the second edge of the bent section 23 in the first plane is an edge of a projection of the bent section 23** in the first plane.

As shown in FIG. 1, in the plane parallel to the left-right direction and the up-down direction, the included angle $\alpha$ between the connecting line between the other end of the projection line of the first edge of the bent section 23 and the other end of the projection line of the second edge of the bent section 23 and the projection line of the first edge of the first section 21 is greater than 10 degrees and less than 60 degrees. Therefore, the bent section 23 forms a slope, and the dust accumulated in the bent section can be easily flushed out of the heat exchanger through the gap D at the bent section by the condensed water generated on the surface of the heat exchanger or the water in the environment.

In some embodiments, as shown in FIG. 1, the heat exchanger 100 further includes baffles 30, the baffles 30 include at least two pairs of baffles 30, one pair of baffles 30 are respectively located on both sides of the plurality of first sections 21 in the length direction of the first tube 11 and the other pair of baffles 30 are respectively located on both sides of the plurality of second sections 22 in the length direction of the second tube 12, so as to fix and protect the heat exchange tubes 20.

In some embodiments, as shown in FIG. 1, the heat exchanger 100 further includes fins 40, the fins 40 include a plurality of fins 40, and the plurality of fins 40 are evenly arranged between the baffle 30 and the heat exchange tube 20 and between the heat exchange tubes 20. The fins can increase the heat exchange area of two adjacent heat exchange tubes and improve the heat exchange efficiency of the heat exchanger.

The heat exchanger according to another embodiment of the present disclosure is described below with reference to FIGS. 2-8.

As shown in FIGS. 2-7, a heat exchanger 100 according to the embodiment of the present disclosure includes a header 10 and a plurality of heat exchange tubes 20.

Figure 2:
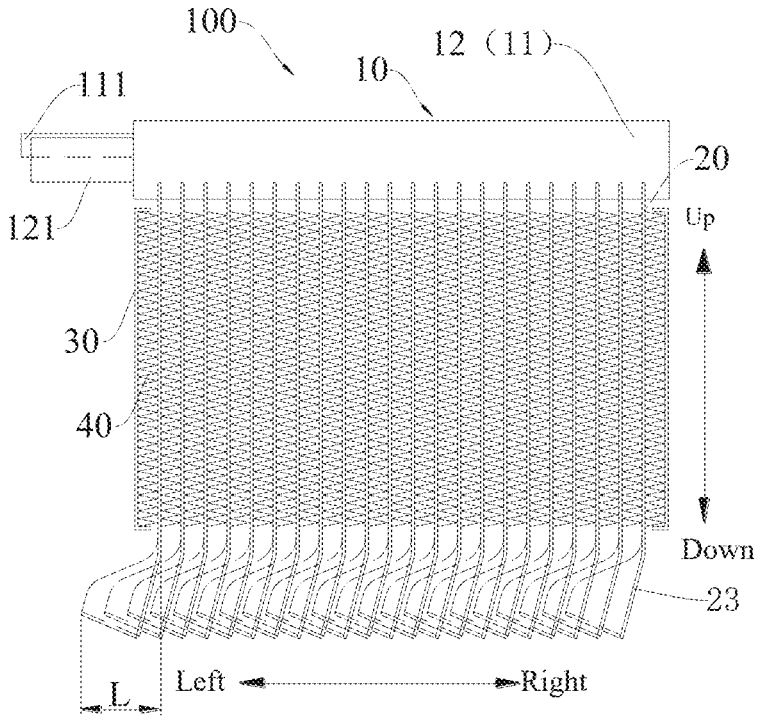
FIG. 2 is a schematic view of a heat exchanger according to another embodiment of the present disclosure.
Figure 3:
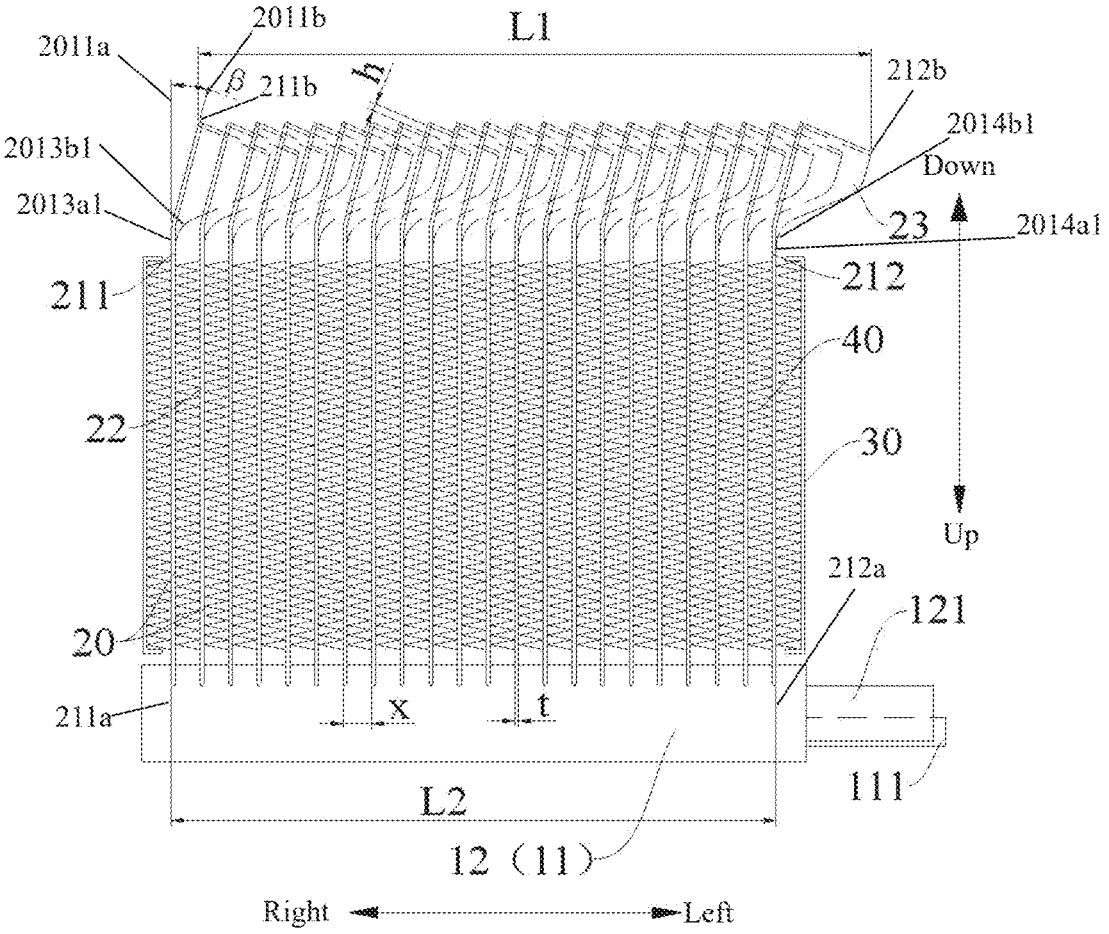
FIG. 3 is a schematic view of the heat exchanger in FIG. 2 from another angle.

The header 10 includes a first tube 11 and a second tube 12, and the first tube 11 and the second tube 12 are spaced apart from each other. As shown in FIG. 2 and FIG. 3, the first tube 11 and the second tube 12 each extend along a left-right direction and spaced apart from each other in a front-rear direction perpendicular to the pages of FIGS. 2 and 3, and the first tube 11 is located behind the second tube 12.

The plurality of heat exchange tubes 20 are spaced apart from each other, and a peripheral profile of a cross section of the heat exchanger tube 20 is substantially flat, i.e. the heat exchange tube 20 is a flat tube. As shown in FIG. 2, the plurality of heat exchange tubes 20 are spaced apart from each other in the left-right direction, each heat exchange tube 20 has a length, a width and a thickness, the length is larger than the width, and the width is greater than the thickness. The length of the heat exchange tube 20 is defined in an up-down direction, the width of the heat exchange tube 20 is defined in the front-rear direction, and the thickness of the heat exchange tube 20 is defined in the left-right direction.

As shown in FIG. 5, the heat exchange tube 20 includes a first side surface 201 and a second side surface 202 arranged parallel to each other in a thickness direction of the heat exchange tube 20, the heat exchange tube 20 also includes a third side surface 203 and a fourth side surface 204 arranged parallel to each other in a width direction of the heat exchange tube 20, and a distance between the first side surface 201 and the second side surface 202 of the heat exchange tube 20 is smaller than a distance between the third side surface 203 and the fourth side surface 204 of the heat exchange tube 20. A peripheral profile of a cross section of the heat exchange tube 20 includes projections of the first side surface 201, the second side surface 202, the third side surface 203 and the fourth side surface 204 in the cross section of the heat exchange tube 20, i.e. the projections of the first side surface 201, the second side surface 202, the third side surface 203 and the fourth side surface 204 in the cross section of the heat exchange tube 20 form the peripheral profile of the cross section of the heat exchange tube 20. That is, the first side surface, the second side surface, the third side surface and the fourth side surface are peripheral surfaces of the heat exchange tube 20.

The first side surface 201 of the heat exchange tube 20 and the third side surface 203 of the heat exchange tube 20 intersect at a first edge, the second side surface 202 of the heat exchange tube 20 and the fourth side surface 204 of the heat exchange tube 20 intersect at a second edge, the second side surface 202 of the heat exchange tube 20 and the third side surface 203 of the heat exchange tube 20 intersect at a third edge, and the first side surface 201 of the heat exchange tube 20 and the fourth side surface 204 of the heat exchange tube 20 intersect at a fourth edge 2014. In some embodiments, the third side surface and/or the fourth side surface may be a curved surface, such as an arc surface, which are connected with the first side surface and the second side surface, respectively.

The heat exchange tube 20 includes a first section 21, a second section 22 and a bent section 23. One end of the bent section 23 of the heat exchange tube 20 is connected with one end of the first section 21, and the other end of the bent section 23 of the heat exchange tube 20 is connected with one end of the second section 22 of the heat exchange tube 20. The other end of the first section 21 of the heat exchange tube 20 is connected to the first tube 11, the other end of the second section 22 of the heat exchange tube 20 is connected to the second tube 12, and the heat exchange tube 20 communicates the first tube 11 with the second tube 12. The bent section 23 of the heat exchange tube 20 includes a torsion part and an arc part. In a thickness direction of the arc part of the bent section 23, the arc parts of the bent sections 23 of two adjacent heat exchange tubes 20 are at least partially opposite.

The plurality of heat exchange tubes 20 are arranged in parallel, the first sections 21 of the plurality of heat exchange tubes 20 are arranged in parallel in an arrangement direction of the plurality of heat exchange tubes 20, and the second sections 22 of the plurality of heat exchange tubes 20 are arranged in parallel in the arrangement direction of the plurality of heat exchange tubes 20. As shown in FIGS. 2-4, the plurality of heat exchange tubes 20 are arranged in the left-right direction, a plurality of first sections 21 are arranged in parallel and spaced apart in the left-right direction, and a plurality of second sections 22 are arranged in parallel and spaced apart in the left-right direction.

The heat exchange tube 20 of the plurality of heat exchange tubes 20 located at one end of the first tube 11 in the length direction of the first tube 11 is a first heat exchange tube 211 (the rightmost heat exchange tube of the plurality of heat exchange tubes 20 in FIG. 3), and the heat exchange tube 20 of the plurality of heat exchange tubes 20 located at the other end of the first tube 11 in the length direction of the first tube 11 is a second heat exchange tube 212 (the leftmost heat exchange tube of the plurality of heat exchange tubes 20 in FIG. 3).

In a first plane parallel to a first edge and a third edge of the first section 21, a distance between a projection 211*a* of a first side surface 201 of the first section 21 of the first heat exchange tube 211 and a projection 212*a* of a second side surface 202 of the first section 21 of the second heat exchange tube 212 is denoted as L2, as shown in FIGS. 1-5 and 11 and FIG. 22, one end 2013*b*1 of a projection line of a third edge of the bent section 23 of the first heat exchange tube 211 is connected with one end 2013*a*1 of a projection line of a third edge of the first section 21 of the first heat exchange tube 211, one end 2014*b*1 of a projection line of a fourth edge of the bent section 23 of the second heat exchange tube 212 is connected with one end 2014*a*1 of a projection line of a fourth edge of the first section 21 of the second heat exchange tube 212, and a distance between the other end 211*b* of the projection line of the third edge of the bent section 23 of the first heat exchange tube 211 and the other end 212*b* of the projection line of the fourth edge of the bent section 23 of the second heat exchange tube 212 is denoted as L1. In the first plane, L1 and L2 satisfy a formula: $L2+0.2Tw \leq L1 < L2+2Tw$, where Tw is the width of the heat exchange tube 20.

In the heat exchanger according to the embodiment of the present disclosure, L1 is associated with L2 and Tw, respectively, and L1 is limited in a range greater than or equal to L2+0.2Tw and less than L2+2Tw, so that an overlapping area of the bent sections of the heat exchange tubes of the heat exchanger can be reduced, and a contact area of the bent sections of the heat exchange tubes can be reduced, which is conducive to slowing down the corrosion of the heat exchange tube, reducing the risk of leakage and prolonging the service life of the heat exchanger. Moreover, a length of the bent section protruding toward a side can be limited, which is beneficial to use and installation. When L1 is too small, not only the overlapping area of adjacent bent sections is large, but also a large stress concentration is caused in a region where the heat exchange tubes are nested or in contact with each other, which will result in serious surface wear of the heat exchange tube. When L2 is too large, the gap between adjacent bent sections is too large, resulting in air leakage or direct dripping of the condensed water during use, which will affect the use effect.

In some embodiments, L1 and L2 satisfy a formula: $L1 < L2+0.96Tw$, as shown in FIG. 3, where Tw is the width of the heat exchange tube 20. Thus, the overlapping area of the bent sections of the heat exchange tubes of the heat exchanger can be reduced, and the contact area of the bent sections of the heat exchange tubes can be reduced, which is conducive to slowing down the corrosion of the heat exchange tube, reducing the risk of leakage and prolonging the service life of the heat exchanger. Moreover, the length of the bent section protruding toward a side can be limited, which is beneficial to use and installation.

Figure 8:
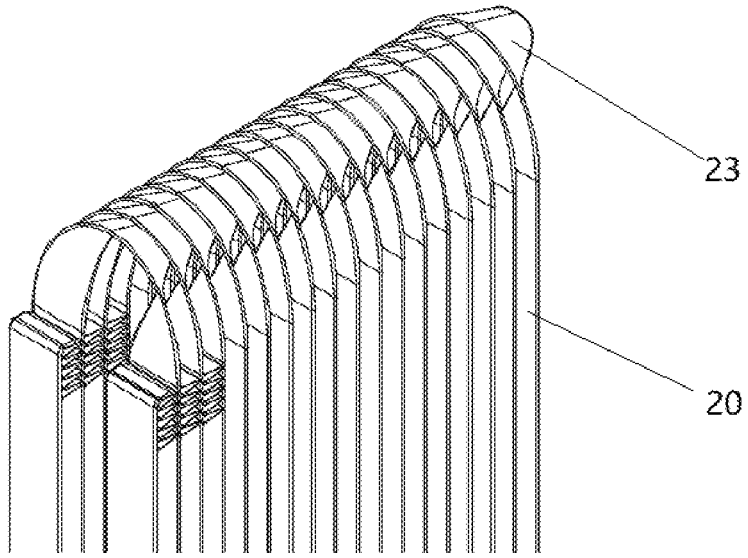
FIG. 8 is a partial perspective view of the heat exchanger in FIG. 2, and shows a bent section.

In some embodiments, as shown in FIGS. 5 and 8, the bent section 23 of the heat exchange tube 20 includes two torsion parts, one end of one torsion part is communicated with the one end of the first section 21 of the heat exchange tube 20, one end of the other torsion part is communicated with the one end of the second section 22 of the heat exchange tube 20, and the arc part communicates the two torsion parts with each other. In some embodiments, in the thickness direction of the arc part of the bent section 23 of the heat exchange tube 20, the arc parts of the bent sections 23 of adjacent heat exchange tubes 20 have a gap therebetween. Therefore, more dust and condensed water on the outer surface of the bent section can be further discharged out of the heat exchanger, and the dust accumulated in the bent section can be reduced.

In some embodiments, as shown in FIG. 3, a minimum value of the gap is denoted as h, and h of the plurality of heat exchange tubes 20 satisfies a formula: $2/3t \leq h < 8.5t$, where t is the thickness of the heat exchange tube. Thus, more dust and condensed water on the outer surface of the bent section can be further discharged out of the heat exchanger, thus reducing the dust accumulated in the bent section.

In other embodiments, as shown in FIG. 3, a minimum value of the gap is denoted as h, and h of the plurality of heat exchange tubes 20 satisfies a formula: $2/3t \leq h < X$, where t is the thickness of the heat exchange tube 20, and X is a distance between the first side surfaces of the heat exchange tubes 20 adjacent to each other in the length direction of the first tube 11. Therefore, more dust and condensed water on the outer surface of the bent section can be further discharged out of the heat exchanger, and the dust accumulated in the bent section can be reduced.

In some embodiments, the first side surface 201 of the heat exchange tube 20 and the third side surface 203 of the heat exchange tube 20 intersect at the first edge, the second side surface 202 of the heat exchange tube 20 and the fourth side surface 204 of the heat exchange tube 20 intersect at the second edge, and the second side surface 202 of the heat exchange tube 20 and the third side surface 203 of the heat exchange tube 20 intersect at the third edge.

In the first plane parallel to the first edge and the third edge of the first section 21 (such as a plane parallel to the left-right direction and the up-down direction in FIG. 2), a minimum included angle between a projection line 2011*b* of a first edge of the bent section 23 in the first plane and the projection line 2011*a* of the first edge of the first section 21 in the first plane is denoted as R, the included angle β is greater than 0 degrees, and the included angles R of the plurality of heat exchange tubes 20 are the same, and satisfy a formula: $L2+Tw \cdot \cos\beta \leq L1 < L2+2Tw$. Thus, the bent section 23 forms a slope, and the dust accumulated in the bent section can be easily flushed out of the heat exchanger through the gap h at the bent section by the condensed water generated on the surface of the heat exchanger or the water in the environment.

The projection line of the bent section 23 may be a curve, so that there are a plurality of corresponding included angles β, and each included angle β satisfies the above formula.

In some embodiments, the included angle β is greater than 10 degrees and less than or equal to 65 degrees. The inclined angle of the slope formed by the bent section 23 increases with the increase of the included angle β, so that the dust accumulated in the bent section can be flushed out of the heat exchanger through the gap h at the bent section more easily.

In some embodiments, one end of a projection line 2012*b* of a second edge of the bent section 23 in the first plane is connected with a projection line 2012*a* of a second edge of the first section 21 in the first plane, a distance between the other end 2012*b*1 of the projection line of the second edge of the bent section 23 in the first plane and an extension line of a projection line 2011*a* of the first edge of the first section 21 in the first plane is denoted as L, and L of the plurality of heat exchange tubes 20 satisfies a formula: $1.1 \times Tw \leq L \leq 3 \times Tw$. In the heat exchanger according to the embodiment of the present disclosure, the bent section of the heat exchange tube protrudes toward a side where the torsion occurs (for example, in the thickness direction of the heat exchange tube or the length direction of the first tube), and it is guaranteed that L satisfies the formula: $1.1 \times Tw \leq L \leq 3 \times Tw$, so that more dust and condensed water on the outer surface of the bent section can be discharged out of the heat exchanger, further reducing the resulted accumulation and reducing the risk of leakage of the heat exchange tube.

Specifically, as shown in FIG. 2, the heat exchanger 100 further includes a first connecting tube 111 and a second connecting tube 112, a right end of the first connecting tube 111 is connected with a left end of the first tube 11, a right end of the second connecting tube 112 is connected with a left end of the second tube 12, so as to input and output a refrigerant through the connecting tubes. The bent section 23 protrudes toward a left side of the heat exchange tube 20.

In some embodiments, the first tube 11 and the second tube 12 are arranged in parallel, a plurality of first sections 21 are arranged in parallel along the length direction of the first tube 11, and a plurality of second sections 22 are arranged in parallel along the length direction of the second tube 12.

As shown in FIG. 2, upper ends of the first sections 21 of the plurality of heat exchange tubes 20 are inserted into the first tube 11, and the plurality of first sections 21 are arranged in parallel and spaced apart along the length direction of the first tube 11. Upper ends of the second sections 22 of the plurality of heat exchange tubes 20 are inserted into the second tube 12, and the plurality of second sections 22 are arranged in parallel and spaced apart along the length direction of the second tube 12.

In some embodiments, the heat exchanger 100 further includes a fin 40, and the fin 40 is arranged between the first sections 21 adjacent to each other in the length direction of the first tube 11 and between the second sections 22 adjacent to each other in the length direction of the second tube 12.

As shown in FIG. 2, the fin 40 is arranged between any adjacent first sections 21 and between any adjacent second sections 22. Specifically, no fin is arranged between any adjacent bent sections 23. In some embodiments, the fin 40 is a folded fin extending in a generally wavy shape. The fin can increase the heat exchange area of two adjacent heat exchange tubes and improve the heat exchange efficiency of the heat exchanger.

Figure 6:
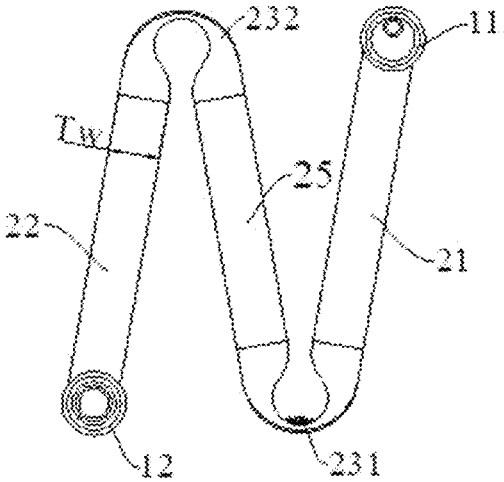
FIG. 6 is a schematic view of a heat exchanger according to another embodiment of the present disclosure.

In some embodiments, the heat exchange tube 20 further includes a third section 25, and the bent section 23 includes a first bent section 231 and a second bent section 232. One end of the first bent section 231 is connected with one end of the first section 21, the other end of the first tube 21 is communicated with the first tube 21, the other end of the first bent section 231 is connected with one end of the third section 25, the other end of the third section 25 is connected to one end of the second bent section 232, the other end of the second bent section 232 is connected to one end of the second section 22, and the other end of the second section 22 is communicated with the second tube 12. As shown in FIG. 6, the first bent section 231 is connected between the first section 21 and the third section 25, the first bent section 231 communicates the first section 21 with the third section 25, the second bent section 232 is connected between the third section 25 and the second section 22, and the second bent section 232 communicates the third section 25 with the second section 22.

Figure 7:
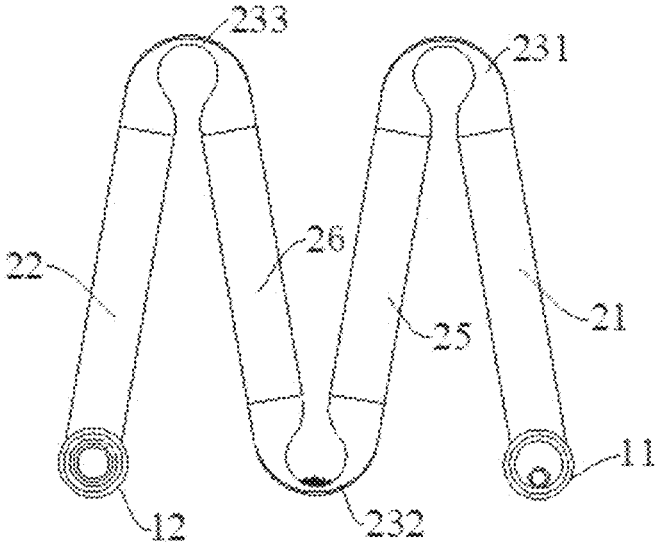
FIG. 7 is a schematic view of a heat exchanger according to another embodiment of the present disclosure.

Furthermore, as shown in FIG. 7, the heat exchange tube further includes a fourth section 26, the bent section further includes a third bent section 233, the second bent section 232 is connected between the third section 25 and the fourth section 26, and the third bent section 233 is connected between the fourth section 26 and the second section 22.

In some embodiments, as shown in FIG. 2, the heat exchanger 100 further includes baffles 30, and the baffles 30 include at least two pairs of baffles 30. One pair of baffles 30 are respectively located on both sides of the plurality of first sections 21 in the length direction of the first tube 11 and the other pair of baffles 30 are respectively located on both sides of the plurality of second sections 22 in the length direction of the second tube 12, so as to fix and protect the heat exchange tubes 20.

A processing method for a heat exchanger according to an embodiment of the present disclosure is described below with reference to FIGS. 9-21.

As shown in FIGS. 9-21, the processing method for the heat exchanger according to the embodiment of the present disclosure includes the following steps.

A heat exchanger is prepared. The heat exchanger includes a first tube 11, a second tube 12, and a plurality of heat exchange tubes 20, and the plurality of heat exchange tubes 20 are arranged in parallel along the length direction of the first tube 11. The heat exchange tube 20 is respectively connected with the first tube 11 and the second tube 12 to communicate the first tube 11 with the second tube 12. A peripheral profile of a cross section of the heat exchange tube 20 is generally flat. The heat exchange tube 20 includes a first side surface 201 and a second side surface 202 arranged parallel to each other in a width direction of the heat exchanger tube 20, and the heat exchange tube 20 further includes a third side surface 203 and a fourth side surface 204 arranged parallel to each other in a width direction of the heat exchange tube 20. A maximum distance between the first side surface 201 and the second side surface 202 of the heat exchange tube 20 is smaller than a maximum distance between the third side surface 203 and the fourth side surface 204 of the heat exchange tube 20. Projections of the first side surface 201, the second side surface 202, the third side surface 203 and the fourth side surface 204 of the heat exchange tube 20 in the cross section of the heat exchange tube 20 form the peripheral profile of the cross section of the heat exchange tube 20.

The heat exchange tube 20 includes a first section 21, a processing section 24 and a second section 22, one end of the first section 21 of the heat exchange tube 20 is connected with one end of the processing section 24, the other end of the first section 21 is communicated with the first tube 11, one end of the second section 22 of the heat exchange tube 20 is connected with the other end of the processing section 24, and the other end of the second section 22 is communicated with the second tube 12. Thus, the first tube 11 is communicated with the second tube 12 through the heat exchange tube 20.

Figure 9:
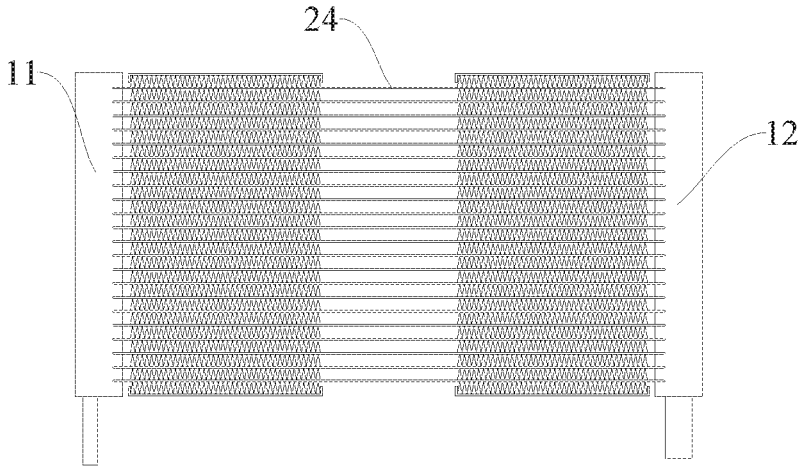
FIG. 9 is a schematic view of a heat exchanger to be bent in a processing method for a heat exchanger according to an embodiment of the present disclosure.
Figure 14:
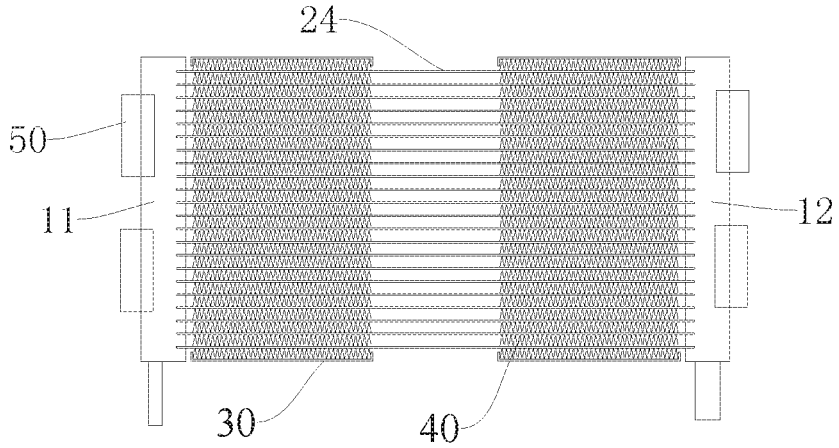
FIG. 14 is a schematic view of fixing a heat exchanger to be bent in a processing method for a heat exchanger according to an embodiment of the present disclosure.

As shown in FIG. 9 and FIG. 14, in the heat exchanger, the first tube 11 and the second tube 12 are arranged in parallel and spaced apart, the heat exchange tube 20 is connected between the first tube 11 and the second tube 12, and the heat exchange tube 20 is a flat tube known in the art. The heat exchange tube 20 includes the first section 21, the second section 22 and the processing section 24 connected between the first section 21 and the second section 22.

As shown in FIG. 14, the heat exchanger can be fixed first, i.e. the first tube 11 and the second tube 12 are fixed by a clamping device 50. Specifically, at least two clamping devices 50 are provided, the at least two clamping devices 50 are uniformly and symmetrically arranged to the first tube 11 and the second tube 12, and the at least two clamping devices 50 fix the heat exchanger on a workbench.

The processing section 24 of the heat exchange tube is twisted along the length direction of the first tube 11 relative to the first section 21 and the second section 22 of the heat exchange tube 20, so that an included angle between the first side surface 201 of the processing section 24 of the heat exchange tube 20 and the first side surface 201 of the first section 21 of the heat exchange tube 20 is greater than 0 degrees.

Figure 10:
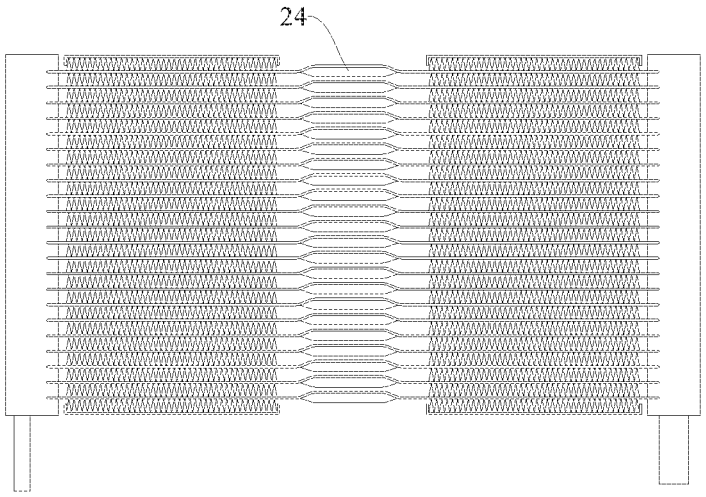
FIG. 10 is a schematic view showing a processing section after being twisted in a processing method for a heat exchanger according to an embodiment of the present disclosure.

As shown in FIG. 10, after the heat exchanger is prepared, the processing section 24 may be twisted.

Figure 15:
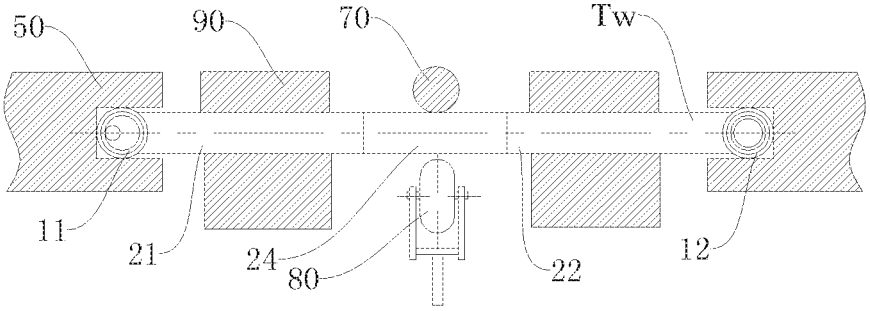
FIG. 15 is a schematic view of twisting a processing section in a processing method for a heat exchanger according to an embodiment of the present disclosure.

As shown in FIG. 15, after the heat exchanger is fixed, the processing section 24 is twisted. Specifically, first of all, a torsion center position of the processing section 24 is located; secondly, the first sections 21 of the plurality of heat exchange tubes 20 are pressed by a pressing plate 90, and the second sections 22 of the plurality of heat exchange tubes 20 are pressed by another pressing plate 90; thirdly, a mandrel 70 is arranged above the torsion center position and closely fitted with upper surfaces of the plurality of processing sections 24; then, a twisting member 80 is arranged below the torsion center position and closely fitted with lower surfaces of the plurality of processing sections 24; then, the twisting member 80 is rolled over the plurality of processing sections 24 along a length direction of the mandrel 70 (defined as a first direction, which is parallel to a direction in which the plurality of heat exchange tubes 20 are spaced apart), so as to twist the processing section 24 to a certain angle, so that the processing section 24 of the heat exchange tube 20 is inclined relative to the first section 21 and the second section 22, and thus the included angle between the first side surface 201 of the processing section 24 of the heat exchange tube 20 and the first side surface 201 of the first section 21 of the heat exchange tube 20 is greater than 0 degrees and less than or equal to 90 degrees.

The processing section 24 is bent along its length direction to make the processing section 24 U-shaped or V-shaped, so that an included angle between the first section 21 and the second section 22 of the heat exchange tube 20 is reduced to a predetermined angle.

Figure 11:
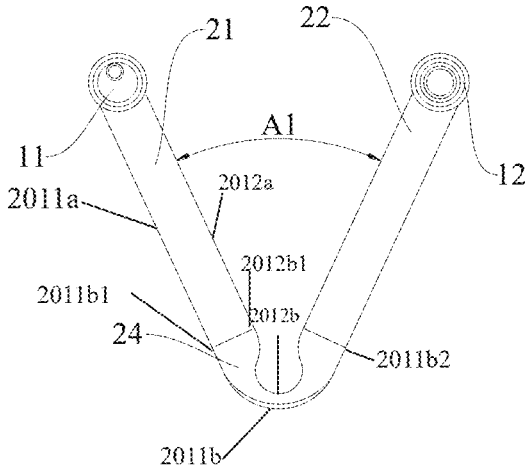
FIG. 11 is a schematic view of bending a first section and a second section to a predetermined angle A1 in a processing method for a heat exchanger according to an embodiment of the present disclosure.
Figure 16:
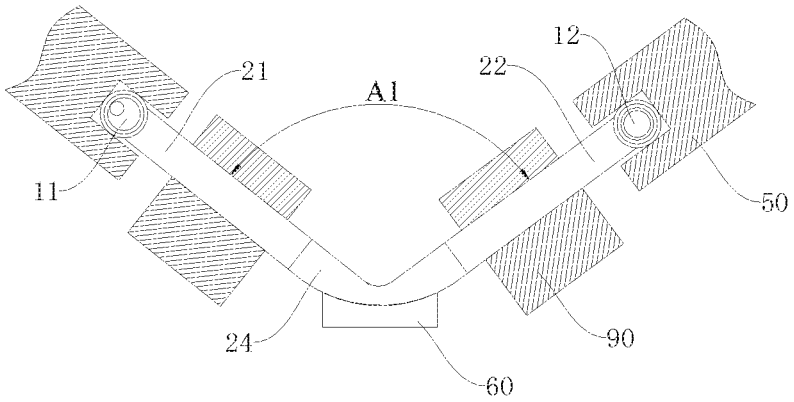
FIG. 16 is a schematic view of bending a first section and a second section to a predetermined angle A1 in a processing method for a heat exchanger according to an embodiment of the present disclosure.
Figure 17:
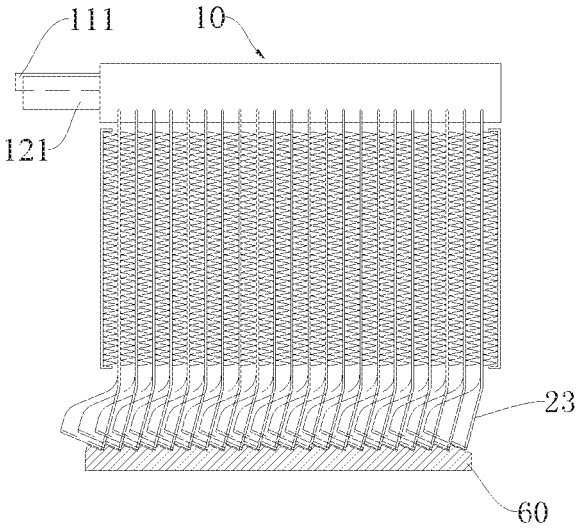
FIG. 17 is a schematic view of translating a processing section in a processing method for a heat exchanger according to an embodiment of the present disclosure.

As shown in FIG. 11 and FIG. 16, the clamping device 50 and the pressing plate 90 are moved upward synchronously, and the first section 21 and the second section 22 of the heat exchange tube 20 are bent with the cooperation of the clamping device 50 and the pressing plate 90, so that the first section 21 and the second section 22 are bent relative to the processing section 24. Thus, the processing section 24 is bent along its length direction, and the processing section 24 is bent into a U shape or a V shape.

The processing section 24 is pushed by a predetermined distance in the same direction as a direction in which the processing section 24 of the heat exchange tube 20 is twisted, and the predetermined distance is greater than or equal to 0.1 times of the width of the heat exchange tube 20.

As shown in FIG. 16, a pushing device 60 is engaged with an outer edge of the processing section 24, and the processing section 24 is pushed in the first direction by the pushing device 60, so that the processing section 24 protrudes by a certain size relative to the first tube 11 and the second tube 12, thereby obtaining the processed heat exchanger, in which the processing section 24 of the heat exchanger forms the bent section 23 of the processed heat exchanger.

In the heat exchanger obtained by the processing method for the heat exchanger according to the embodiment of the present disclosure, the bent section of the heat exchange tube protrudes toward a side where the torsion occurs, so that more dust on the outer surface of the bent section can be discharged out of the heat exchanger under the action of the rainwater and the condensed water, thus reducing the resulted accumulation, which is conducive to slowing down the corrosion of the heat exchange tube and reducing the risk of leakage.

In some embodiments, the step of bending the first section 21 and the second section 22 of the heat exchange tube 20 relative to the processing section 24 includes the following sub-steps.

At step S1: the first sections 21 and the second sections 22 of the plurality of heat exchange tubes 20 are bent relative to their respective processed sections 24, and an angle between a length direction of the first section 21 and a length direction of the second section 22 is bent to a preset angle A1.

As shown in FIG. 16, the clamping device 50 and the pressing plate 90 are moved upward synchronously, and the first section 21 and the second section 22 of the heat exchange tube 20 are bent with the cooperation of the clamping device 50 and the pressing plate 90, so that the first section 21 and the second section 22 are bent relative to the processing section 24, and an included angle between an axis of the first section 21 and an axis of the second section 22 is denoted as A1. Specifically, a range of A1 may be: $60° \leq A1 \leq 135°$.

At step S2: the processing section 24 continues to be bent along its length direction, and the angle between the length direction of the first section 21 and the length direction of the second section 22 is bent to a target angle A2, in which $A2 \geq 0°$, and A2 is smaller than A1.

Figure 18:
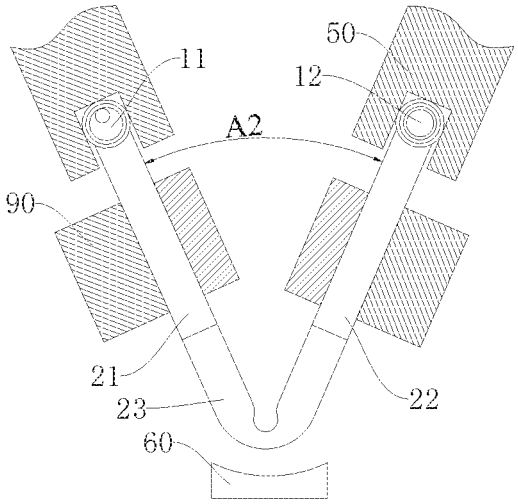
FIG. 18 is a schematic view of bending a first section and a second section to a predetermined angle A2 in a processing method for a heat exchanger according to an embodiment of the present disclosure.

As shown in FIG. 18, the clamping device 50 and the pressing plate 90 continues to be moved upward, the first section 21 and the second section 22 of the heat exchange tube 20 are bent with the cooperation of the clamping device 50 and the pressing plate 90, so that the first section 21 and the second section 22 continue to be bent relative to the processing section 24, and the included angle between the axis of the first section 21 and the axis of the second section 22 is A2. Specifically, $A2 \geq 0°$, and A2 is smaller than A1.

In some embodiments, the step of pushing the processing section 24 by a predetermined distance in the same direction as a direction in which the processing section 24 of the heat exchange tube 20 is twisted is performed after the step S1 and before the step S2; or, the step of pushing the processing section 24 by a predetermined distance in the same direction as a direction in which the processing section 24 of the heat exchange tube 20 is twisted is performed synchronously with step S2.

Figure 12:
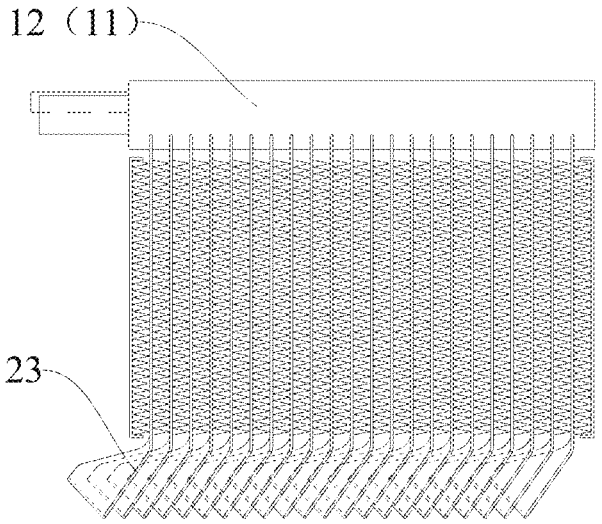
FIG. 12 is a schematic view showing a processing section after being translated in a processing method for a heat exchanger according to an embodiment of the present disclosure.
Figure 13:
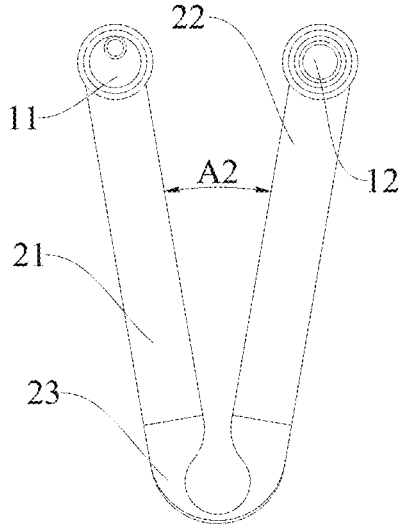
FIG. 13 is a schematic view of bending a first section and a second section to a predetermined angle A2 in a processing method for a heat exchanger according to an embodiment of the present disclosure.

As shown in FIG. 11 and FIG. 12, the actions of FIG. 11 and FIG. 12 can be performed synchronously or step by step, for example:

(1) after the action shown in FIG. 11 starts and before the action shown in FIG. 11 ends, the action shown in FIG. 12 starts to be performed, the action shown in FIG. 11 continues to be performed, the action shown in FIG. 11 ends, the action shown in FIG. 12 continues to be performed, and the action shown in FIG. 12 ends.

(2) after the action shown in FIG. 11 starts and before the action shown in FIG. 11 ends, the action shown in FIG. 12 starts to be performed, the action shown in FIG. 11 continues to be performed, the action shown in FIG. 11 ends, and the action shown in FIG. 12 ends.

(3) the action shown in FIG. 11 ends, the action shown in FIG. 12 starts, and the action shown in FIG. 12 ends.

(4) the actions shown in FIG. 11 and FIG. 12 start simultaneously, and the actions shown in FIG. 11 and FIG. 12 end.

In some embodiments, at least one of a plurality of processing sections 24 is sequentially pushed in the same direction (the first direction) as the direction in which the processing section 24 of the heat exchange tube 20 is twisted, or a plurality of processing sections 24 are simultaneously pushed in the same direction (the first direction) as the direction in which the processing section 24 of the heat exchange tube 20 is twisted.

Figure 19:
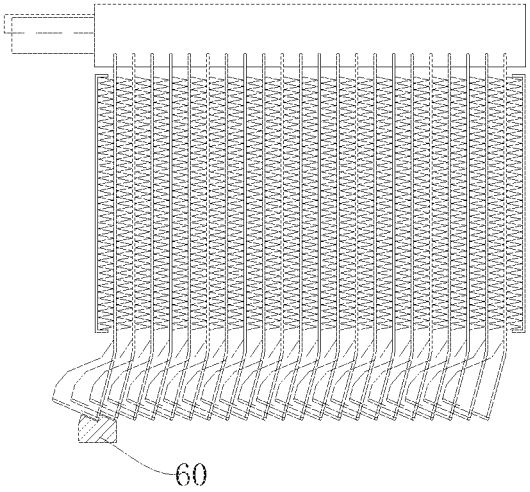
FIG. 19 is a schematic view of an embodiment of translating the processing section in FIG. 17.
Figure 20:
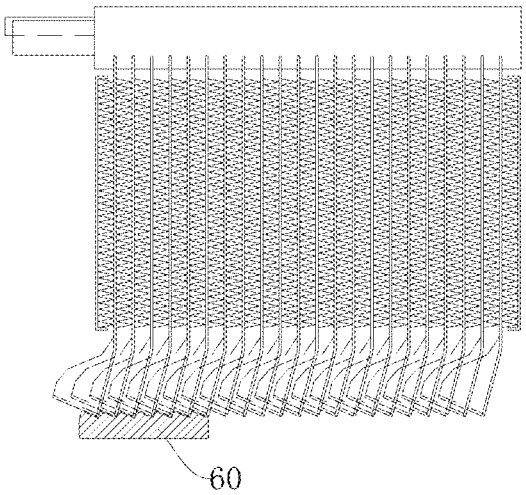
FIG. 20 is a schematic view of another embodiment of translating the processing section in FIG. 17.
Figure 21:
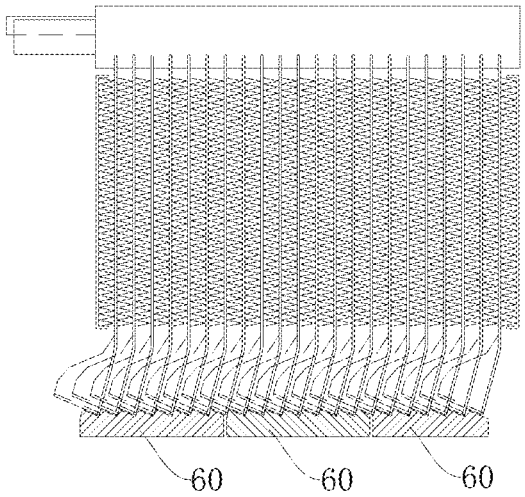
FIG. 21 is a schematic view of another embodiment of translating the processing section in FIG. 17.
Figure 22:
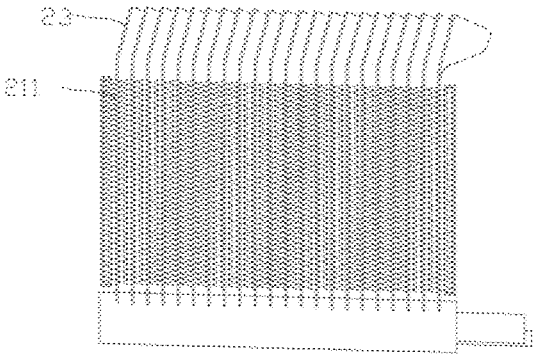
FIG. 22 is a schematic view of a heat exchanger according to another embodiment of the present disclosure.

As shown in FIGS. 19-21, when the processing section 24 is pushed by the pushing device 60, in order to reduce a pushing force on the processing section 24 and prevent the irregular deformation of the processing section 24, the pushing device 60 can push a single processing section 24 (as shown in FIG. 19) sequentially step by step, or can push a plurality of groups of processing sections 24 in the plurality of bending sections 24 sequentially step by step, in which each group of processing sections include at least two processing sections 24.

In some embodiments, the above predetermined distance of pushing is smaller than the width of the heat exchange tube, so that more dust on the outer surface of the bent section is further discharged out of the heat exchanger under the action of the rainwater and the condensed water, thus reducing the resulted accumulation.

In some embodiments, at least one of the plurality of processing sections 24 is twisted sequentially along the length direction of the first tube 11, or the plurality of processing sections 24 are twisted simultaneously.

In some embodiments, a twisting paddle or a roller is used to be sequentially in contact with the first side surface 201 or the second side surface 202 of the processing section 24 along the length direction of the first tube 11, so that the processing section 24 is twisted relative to the first section 21 and the second section 22 of the heat exchange tube 20. After the processing section 24 is twisted by moving the roller or twisting the paddle, the processing section 24 is offset and twisted downward relative to the first section 21 and the second section 22 as a whole. In other words, the twisting member 80 is a roller, and the roller cooperates with the mandrel 70 to twist the processing section 24, or the twisting member 80 is a twisting paddle, and the processing section 24 is twisted by the twisting paddle.

In some embodiments, as shown in FIGS. 9-21, the heat exchanger further includes a fin 40, the fin 40 is arranged between the first sections 21 of the heat exchange tubes 20 adjacent to each other in the length direction of the first tube 11 and between the second sections 22 of the heat exchange tubes 20 adjacent to each other in the length direction of the first tube 11, and no fin is arranged between the processing sections 24 of the heat exchange tubes 20 adjacent to each other in the length direction of the first tube 11. In other words, the heat exchange tube is twisted and bent at a region where no fin is arranged.

In the description of the present disclosure, it is to be understood that, terms such as "central", "longitudinal", "lateral", "length", "width", "thickness", "up", "down", "front", "rear", "left", "right", "vertical", "horizontal", "top", "bottom", "inner", "outer", "clockwise", "anticlockwise", "axial", "radial", "circumferential" and the like are based on the orientation or position relationships shown in the drawings, only for the convenience of describing the present disclosure and simplifying the description, rather than indicating or implying that the referred devices or elements must have a specific orientation or be constructed and operated in a specific orientation, and therefore should not be construed as limiting the present disclosure.

In addition, terms such as "first" and "second" are used herein for purposes of description and are not intended to indicate or imply relative importance or implicitly indicate the number of the features referred to. Therefore, the features defined with "first" and "second" can include at least one of these features explicitly or implicitly. In the description of this disclosure, "a plurality of" means at least two, such as two, three, etc., unless otherwise specifically defined.

In the present disclosure, unless otherwise expressly defined, terms such as "mounting," "interconnection," "connection," "fixing" shall be understood broadly, and may be, for example, fixed connections, detachable connections, or integral connections; may also be mechanical or electrical connections or intercommunication; may also be direct connections or indirect connections via intervening media; may also be inner communications or interactions of two elements. For those skilled in the art, the specific meaning of the above terms in the present disclosure can be understood according to the specific situations.

In the present disclosure, unless otherwise expressly defined and specified, a structure in which a first feature is "on" or "below" a second feature may include an embodiment in which the first feature is in direct contact with the second feature, or may further include an embodiment in which the first feature and the second feature are in indirect contact through intermediate media. Furthermore, a first feature "on," "above," or "on top of" a second feature may include an embodiment in which the first feature is right or obliquely "on," "above," or "on top of" the second feature, or just means that the first feature is at a height higher than that of the second feature, while a first feature "below," "under," or "on bottom of" a second feature may include an embodiment in which the first feature is right or obliquely "below," "under," or "on bottom of" the second feature, or just means that the first feature is at a height lower than that of the second feature.

In the description of the present disclosure, terms such as "an embodiment," "some embodiments," "an example," "a specific example," or "some examples," means that a particular feature, structure, material, or characteristic described in connection with the embodiment or example is included in at least one embodiment or example of the present disclosure. Thus, the appearances of these terms in various places throughout this specification are not necessarily referring to the same embodiment or example of the present disclosure. Furthermore, the particular features, structures, materials, or characteristics may be combined in any suitable manner in one or more embodiments or examples. In addition, without contradiction, those skilled in the art may combine and unite different embodiments or examples or features of the different embodiments or examples described in this specification.

Although the embodiments of the present disclosure have been shown and described above, it can be understood that the above embodiments are exemplary and shall not be understood as limitation to the present disclosure, and changes, modifications, alternatives and variations can be made in the above embodiments within the scope of the present disclosure by those skilled in the art.

What is claimed is:

1. A heat exchanger, comprising:

a first tube and a second tube spaced apart from each other;

a plurality of heat exchange tubes spaced apart from each other, wherein the plurality of heat exchange tubes are arranged in parallel along a length direction of the first tube, each heat exchange tube is respectively connected with the first tube and the second tube to communicate the first tube with the second tube, and, for at least one of the plurality of heat exchange tubes, a peripheral profile of a cross section of the at least one of the plurality of heat exchange tubes is generally flat, the at least one of the plurality of heat exchange tubes comprises a first side surface and a second side surface arranged in parallel in a thickness direction of the at least one of the plurality of heat exchange tubes, the at least one of the plurality of heat exchange tubes further comprises a third side surface and a fourth side surface arranged in parallel in a width direction of the at least one of the plurality of heat exchange tubes, a maximum distance between the first side surface and the second side surface of the at least one of the plurality of heat exchange tubes is smaller than a maximum distance between the third side surface and the fourth side surface of the- at least one of the plurality of heat exchange tubes, the peripheral profile of the cross section of the at least one of the plurality of heat exchange tubes comprises projections of the first side surface, of the second side surface, of the third side surface and of the fourth side surface in the cross section of the at least one of the plurality of heat exchange tubes; the first side surface of the at least one of the plurality of heat exchange tubes intersects with the third side surface of the at least one of the plurality of heat exchange tubes at a first edge, the second side surface of the at least one of the plurality of heat exchange tubes intersects with the fourth side surface of the at least one of the plurality of heat exchange tubes at a second edge, the second side surface of the at least one of the plurality of heat exchange tubes intersects with the third side surface of the at least one of the plurality of heat exchange tubes at a third edge, the first side surface of the at least one of the plurality of heat exchange tubes intersects with the fourth side surface of the at least one of the plurality of heat exchange tubes at a fourth edge, the at least one of the plurality of heat exchange tubes comprises a first section, a second section and a bent section; one end of the bent section of the at least one of the plurality of heat exchange tubes is connected with one end of the first section of the at least one of the plurality of heat exchange tubes, an other end of the bent section of the at least one of the plurality of heat exchange tubes is connected with one end of the second section of the at least one of the plurality of heat exchange tubes, the another end of the first section of the at least one of the plurality of heat exchange tubes is connected with the first tube, another end of the second section of the at least one of the plurality of heat exchange tubes is connected with the second tube, and the at least one of the plurality of heat exchange tubes communicates the first tube with the second tube, in a first plane parallel to the first edge and the third edge located in the first section, one end of a projection line of the second edge located in the bent section is connected with a projection line of the second edge located in the first section, a distance between another end of the projection line of the second edge located in the bent section and a projection line of the first edge located in the first section is denoted as L, and L of the at least one of the plurality of heat exchange tubes satisfies a formula: $1.1\times Tw\leq L\leq 3\times Tw$, wherein Tw is a width of the at least one of the plurality of heat exchange tubes;

a minimum included angle between a projection line of the first edge located in the bent section in the first plane and the projection line of the first edge located in the first section in the first plane is denoted as β, the angle β is greater than 0 degrees, and the included angles β of the plurality of heat exchange tubes are the same, and satisfy a formula:

$$L2+Tw\cdot\cos\beta\leq L1<L2+2Tw;$$

one end of a projection line of the first edge located in the bent section in the first plane is connected to the projection line of the first edge located in the first section in the first plane, and a connecting line between another end of the projection line of the first edge located in the bent section in the first plane and another end of the projection line of the second edge located in the bent section in the first plane and the projection line of the first edge located in the first section in the first plane define an included angle denoted as α therebetween, and the included angle α is greater than 10 degrees and less than 60 degrees; and the bent section forms a slope.

2. The heat exchanger according to claim 1, wherein first sections of the plurality of heat exchange tubes are arranged in parallel in an arrangement direction of the plurality of heat exchange tubes; in the plurality of heat exchange tubes, a heat exchange tube located at an end of the first tube in a length direction of the first tube is a first heat exchange tube, a heat exchange tube located at another end of the first tube in the length direction of the first tube is a second heat exchange tube; in the first plane parallel to the first edge and the third edge located in the first section of one of the plurality of heat exchange tube, a distance between a projection of a first side surface of a first section of the first heat exchange tube and a projection of a second side surface of a first section of the second heat exchange tube is denoted as L2, one end of a projection line of the third edge located in a bent section of the first heat exchange tube is connected with one end of a projection line of the third edge located in the first section of the first heat exchange tube, one end of a projection line of the fourth edge located in a bent section of the second heat exchange tube is connected with one end of a projection line of the fourth edge located in the first section of the second heat exchange tube, a distance between another end of the projection line of the third edge located in the bent section of the first heat exchange tube and another end of the projection line of the fourth edge located in the bent section of the second heat exchange tube is denoted as L1, and in the first plane, L1 and L2 satisfy a formula: $L2+0.2Tw\leq L1<L2+2Tw$.

3. The heat exchanger according to claim 2, wherein L1 and L2 satisfy a formula: $L1<L2+0.96Tw$.

4. The heat exchanger according to claim 1, wherein the bent section comprises a torsion part and an arc part, and the bent section and an adjacent bent section in a thickness direction of the arc part of the bent section are at least partially opposite in the thickness direction of the arc part of the bent section.

5. The heat exchanger according to claim 4, wherein the bent section of the at least one heat exchange tube comprises two torsion parts, one end of one torsion part is communicated with the one end of the first section of the heat exchange tube, one end of another torsion part is communicated with the one end of the second section of the at least one heat exchange tube, and the arc part communicates the two torsion parts with each other.

6. The heat exchanger according to claim 4, wherein in the thickness direction of the arc part of the bent section of at least one heat exchange tube, arc parts of bent sections of adjacent heat exchange tubes have a gap therebetween.

7. The heat exchanger according to claim 6, wherein a minimum value of the gap between arc parts of bent sections of adjacent heat exchange tubes is denoted as h, and h of the plurality of heat exchange tubes satisfies at least one of formulas: $2/3t\leq h<8.5t$, wherein t is a thickness of the heat exchange tube; and, $2/3t\leq h<X$, wherein t is a thickness of each heat exchange tube, and X is a distance between first side surfaces of the plurality of heat exchange tubes adjacent to each other in a length direction of the first tube.

8. The heat exchanger according to claim 1, wherein the bent sections of the heat exchange tubes adjacent to each other in a length direction of the first tube have a gap therebetween.

9. The heat exchanger according to claim 1, wherein the first tube and the second tube are arranged in parallel, a plurality of first sections are arranged in parallel along a length direction of the first tube, and a plurality of second sections are arranged in parallel along a length direction of the second tube, the heat exchanger further comprises fins, the fins is arranged between first sections adjacent to each other in the length direction of the first tube and between second sections adjacent to each other in the length direction of the second tube.

* * * * *